US010196228B2

(12) United States Patent
Allen et al.

(10) Patent No.: US 10,196,228 B2
(45) Date of Patent: Feb. 5, 2019

(54) METHOD AND APPARATUS FOR ADJUSTING FOLD ROLLER GAPS

(71) Applicant: Pitney Bowes Inc., Danbury, CT (US)

(72) Inventors: Robert J Allen, Shelton, CT (US); Michael R Ifkovits, Danbury, CT (US); Boris Rozenfeld, Danbury, CT (US); George Cruz, Stratford, CT (US); Edward M. Ifkovits, New Fairfield, CT (US)

(73) Assignee: DMT Solutions Global Corporation, Danbury, CT (US)

( * ) Notice: Subject to any disclaimer, the term of this patent is extended or adjusted under 35 U.S.C. 154(b) by 234 days.

(21) Appl. No.: 15/181,828

(22) Filed: Jun. 14, 2016

(65) Prior Publication Data

US 2017/0313540 A1 Nov. 2, 2017

Related U.S. Application Data

(60) Provisional application No. 62/328,713, filed on Apr. 28, 2016.

(51) Int. Cl.
*B65H 45/20* (2006.01)
*B65H 45/14* (2006.01)

(52) U.S. Cl.
CPC ..... *B65H 45/147* (2013.01); *B65H 45/142* (2013.01); *B65H 45/20* (2013.01); *B65H 2301/451* (2013.01); *B65H 2301/452* (2013.01); *B65H 2403/25* (2013.01); *B65H 2403/51* (2013.01); *B65H 2404/1441* (2013.01); *B65H 2511/13* (2013.01); *B65H 2511/224* (2013.01); *B65H 2701/182* (2013.01)

(58) Field of Classification Search
CPC ..... B65H 45/147; B65H 45/20; B65H 2301/452; B65H 2301/451; B65H 2403/25; B65H 2404/1441
See application file for complete search history.

(56) References Cited

U.S. PATENT DOCUMENTS 2,847,209 A * 8/1958 Olson ..... B65H 45/142 493/421
3,089,695 A * 5/1963 Brooks ..... B65H 45/147 493/419

(Continued)

FOREIGN PATENT DOCUMENTS

DE 102006057465 A1 6/2008
GB 290530 5/1928
JP 61069637 10/1986

*Primary Examiner* — Patrick H Mackey
(74) *Attorney, Agent, or Firm* — Michael J. Cummings

(57) ABSTRACT

A collation folding device comprising one or more fold rollers mounted in fixed positions. Below and adjacent to the fold rollers are adjustable nip rollers to form nip spacing between the rollers. The adjustable nip roller is mounted on a nip axis shaft. An adjustment mechanism is used for moving the nip axis shaft to adjust the nip spacing. The nip adjustment mechanism includes a bearing block cam follower on which the nip axis shaft is fixedly mounted and supported. An eccentric cam in operative contact with the bearing block cam follower. Rotation of the eccentric cam on the eccentric cam axis drives the bearing block cam follower in its linear motion to adjust the nip spacing.

15 Claims, 7 Drawing Sheets

(56) References Cited

U.S. PATENT DOCUMENTS

| | | | | | |
|---|---|---|---|---|---|
| 3,211,448 | A * | 10/1965 | Stoothoff | B65H 45/144 | 493/421 |
| 3,328,026 | A * | 6/1967 | Bartizal, Jr. | B65H 45/144 | 116/282 |
| 3,915,446 | A * | 10/1975 | Boyer | B65H 45/147 | 493/421 |
| 4,099,710 | A * | 7/1978 | Boyer | B65H 45/147 | 493/420 |
| 4,125,254 | A * | 11/1978 | Boyer | B65H 45/147 | 493/420 |
| 4,225,128 | A * | 9/1980 | Holyoke | B65H 45/147 | 493/421 |
| 5,242,364 | A * | 9/1993 | Lehmann | B65H 45/144 | 493/15 |
| 6,475,129 | B1 * | 11/2002 | Lehmann | B65H 45/144 | 493/25 |
| 6,743,161 | B2 * | 6/2004 | Dannemann | B65H 45/144 | 493/23 |
| 7,175,738 | B2 * | 2/2007 | Lindsay | B43M 5/047 | 156/442.1 |
| 7,303,520 | B2 * | 12/2007 | Biondi | B65B 61/20 | 493/420 |
| 2005/0092440 | A1 * | 5/2005 | Lindsay | B43M 5/047 | 156/442.1 |
| 2007/0222134 | A1 * | 9/2007 | Katayama | B65H 45/147 | 270/41 |
| 2011/0160027 | A1 | 6/2011 | Pressman | | |

* cited by examiner

METHOD AND APPARATUS FOR ADJUSTING FOLD ROLLER GAPS

This application claims the benefit of provisional application 62/328,713, filed Apr. 28, 2016, having the same title.

FIELD OF THE INVENTION

The present invention relates to a folder and, more particularly, to a folder for folding variable thickness collations.

BACKGROUND OF THE INVENTION

Folders are used in many document production and handling applications, such as in mail finishing systems, for example. In those applications it is necessary for the folders to fold collations containing a variable number of documents and, therefore, having variable thicknesses.

Conventional folder systems utilize rollers arranged at fixed distances, creating nips having fixed sizes. Those nips are generally configured to process collations of a given size. In some arrangements, in order for the folder to process larger collations, manual adjustment of the rollers is required. The adjustment process is very time consuming and, once the rollers are adjusted for larger collations, the folder is unable to process smaller collations. This adjustment process may require a service technician to set the roller gaps by removing covers and brackets, loosening the drive chain, loosening the fasteners that hold the rollers fixed, and using gage blocks to set the correct gap. The complexity of the procedure makes it very difficult for a typical operator to perform without special technician training.

In other arrangements, passive, spring-biased rollers are used to adjust the roller spacing to accommodate collations having varied thicknesses. Such systems allow the processing of collations within a given thickness range, but lead to excessive force and noise when race sing thicker collations. In addition, such systems often destroy the documents of the collation by leaving visible marks on the documents from the rollers.

SUMMARY OF EXEMPLARY ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

The invention crease a more user friendly method of roller gap adjustment that does not require the advanced skill or experience of a service technician. The improvement also results in more precision, time saving, automated setup, and dynamic adjustment.

In accordance with the purpose of the invention, as embodied and broadly described herein, the invention relates to a collation folding device comprising one or more fold rollers mounted in fixed positions. Below and adjacent to the fold rollers are adjustable nip rollers. Between the fold roller and adjustable roller a nip spacing is formed.

The adjustable nip roller is mounted on a nip axis shaft. The nip axis shaft is mounted so as to be linearly movable to adjust the nip spacing. An adjustment mechanism is used for moving the nip axis shaft to adjust the nip spacing. The nip adjustment mechanism includes a beating block cam follower on which the nip axis shaft is fixedly mounted and supported.

The bearing block cam follower is linearly movable to move the nip axis shaft closer and farther from the one or more fold rollers. An eccentric cam in operative contact with the bearing block cam follower. Rotation of the eccentric cam on the eccentric cam axis drives the bearing block cam follower in its linear motion to adjust the nip spacing.

In a further embodiment, the adjustment mechanism includes a manual turning handle and adjustment shaft for turning the eccentric cam axis to adjust the nip spacing. The adjustment haft includes a series for adjustment slots around an outer circumference of the adjustment shaft. A biased pin is positioned to engage with the adjustment slots to prevent turning of the eccentric cam axis while the biased pin is engaged in the adjustment slots. The adjustment slots represent predetermined positions of the eccentric cam that will result in predetermined nip spacing when the adjustment shaft is turned to engage with the biased pin at different slot positions.

In another embodiment, the bearing block eccentric follower is configured to surround the eccentric cam such that a first follower surface is being pushed by the cam when the bearing block eccentric follower is being pushed towards the one or more fold rollers. A second follower surface, opposite from the first follower surface, is being pushed by the cam in an opposite direction when the bearing block eccentric follower is being pushed away from the one or more fold rollers.

In another alternative arrangement, the eccentric cam axis is driven by a motor. A motor controller causes adjustment of the nip spacing by controlling rotation of the eccentric cam axis to predetermined positions.

In a further embodiment, the adjustment mechanism comprises bearing block eccentric followers and corresponding eccentric cams at both ends of the nip axis shaft. The corresponding eccentric cams share a common cam shaft that extends parallel to the nip axis shaft, whereby rotation of the common cam shaft causes both sides of the nip axis shaft to be adjusted by a same spacing.

In another alternative embodiment, a second independent adjustment mechanism is positioned at an opposite end of the nip axis shaft. The second independent adjustment mechanism comprises a second bearing block eccentric follower and a second corresponding eccentric cam at an opposite end of the nip axis shaft. The second independent adjustment mechanism can be adjusted to a different nip spacing at the opposite end of the nip axis shaft.

In a preferred embodiment, a single chain turns the one or more fold rollers and the adjustable nip roller. In that arrangement, adjustment of the adjustable nip roller changes a length of the single chain needed to turn the rollers. The adjustment mechanism further comprises an automatic tensioner that automatically adjusts tension on the single chain to account for movement of the adjustable nip roller.

The automatic tensioner comprises a pivoting link arm that is in operative communication with the bearing block cam follower such that the pivoting link arm moves back and forth following the movement of the bearing block cam follower. An idler sprocket is mounted on the pivoting arm and is engaged with the single chain. The movement of the pivoting link arm causes the idler sprocket to take up extra tension when the nip spacing is being decreased and to release tension when the nip spacing is being increased. The pivoting link arm is spring biased towards the bearing block cam follower. The pivoting link arm includes a follower arm that extends from the link arm to engage with a surface of the bearing block cam follower.

As used herein, "collation" means a collection of one or more documents.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Embodiments of the folder according the invention will be described with reference to certain applications in mailpiece inserter systems. It should be understood, however, that embodiments of the invention may be used in association with other systems configured to handle and transport collations.

Figure 1:
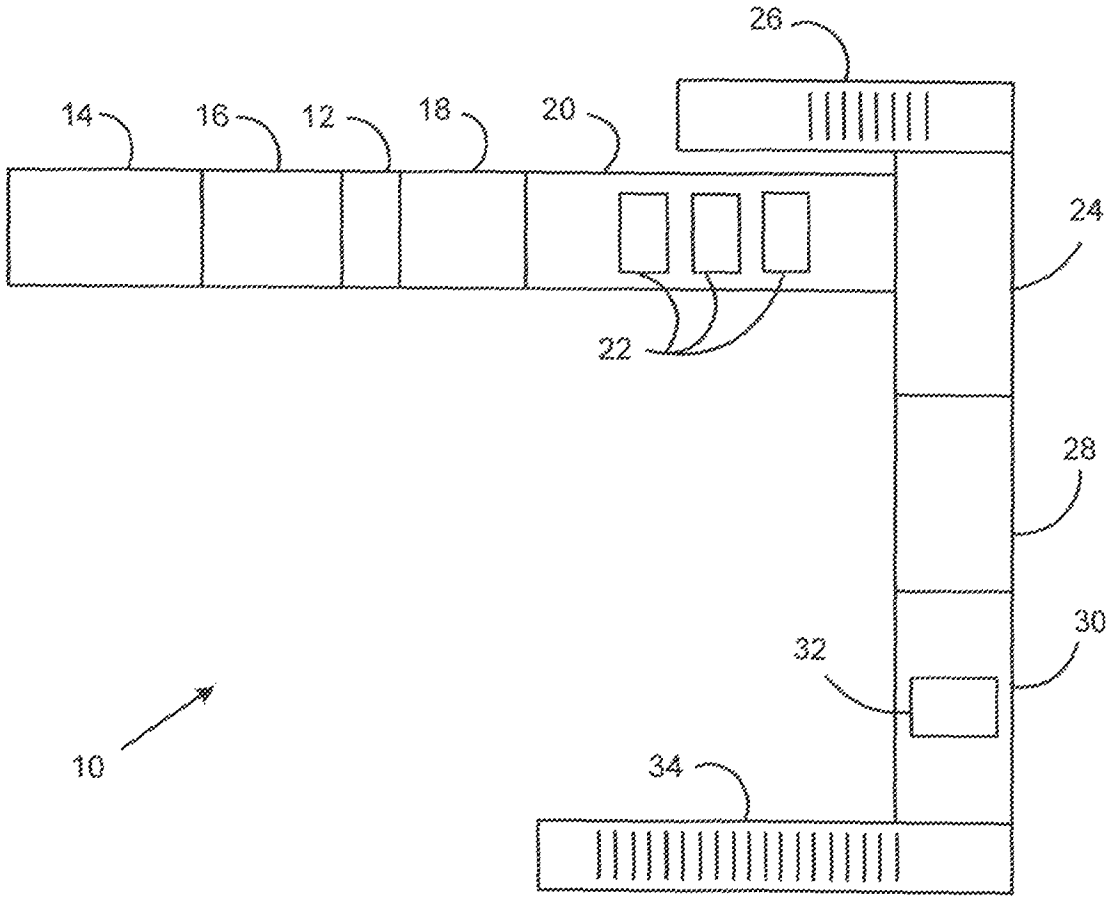
FIG. 1 is a schematic view of an inserter system utilizing an embodiment of the folder of the present invention.

A schematic view of an inserter system 10 incorporating the folder 12 of invention is shown in FIG. 1. The illustrated exemplary inserter system 10 comprises a document feeder 14, which provides pre-printed documents for processing. The documents, which may comprise bills or financial statements, for example, may be provided by the document feeder 14 as individual "cut sheets," or may be cut from a spool using a web cutter (not shown).

The documents next move to an accumulator 16, where the documents for respective mailpieces are assembled into collations. The collations then enter the folder 12, as discussed below, where they are folded. The folded collations next move to a buffer 18, which holds the collations for sequential processing. The collations next move to a chassis 20. As each collation moves through the chassis, inserts from a plurality of feeder modules 22 are added to the collation.

The collations next enter an insertion area 24, where the finished collations are stuffed into envelopes provided by an envelope hopper 26, and the envelopes are sealed. The stuffed, sealed envelopes then enter an outsort module 28, for optionally diverting defective envelopes from the production stream. Defective envelopes may have collations that are improperly assembled and/or may be improperly sealed, for example.

The properly assembled and sealed envelopes next enter a metering and printing area 30, where markings, such as a postage indicia and/or address information, for example, are applied using a printer 32 to form completed mailpieces. Finally, the completed mailpieces are deposited on a conveyor 34. Other systems utilizing more or fewer components and/or different arrangements of components may also be used. It should also be understood that the improvements described in this application can also be used in a standalone folder, and there is no need for the folder to be part of a larger document production system.

Figure 2:
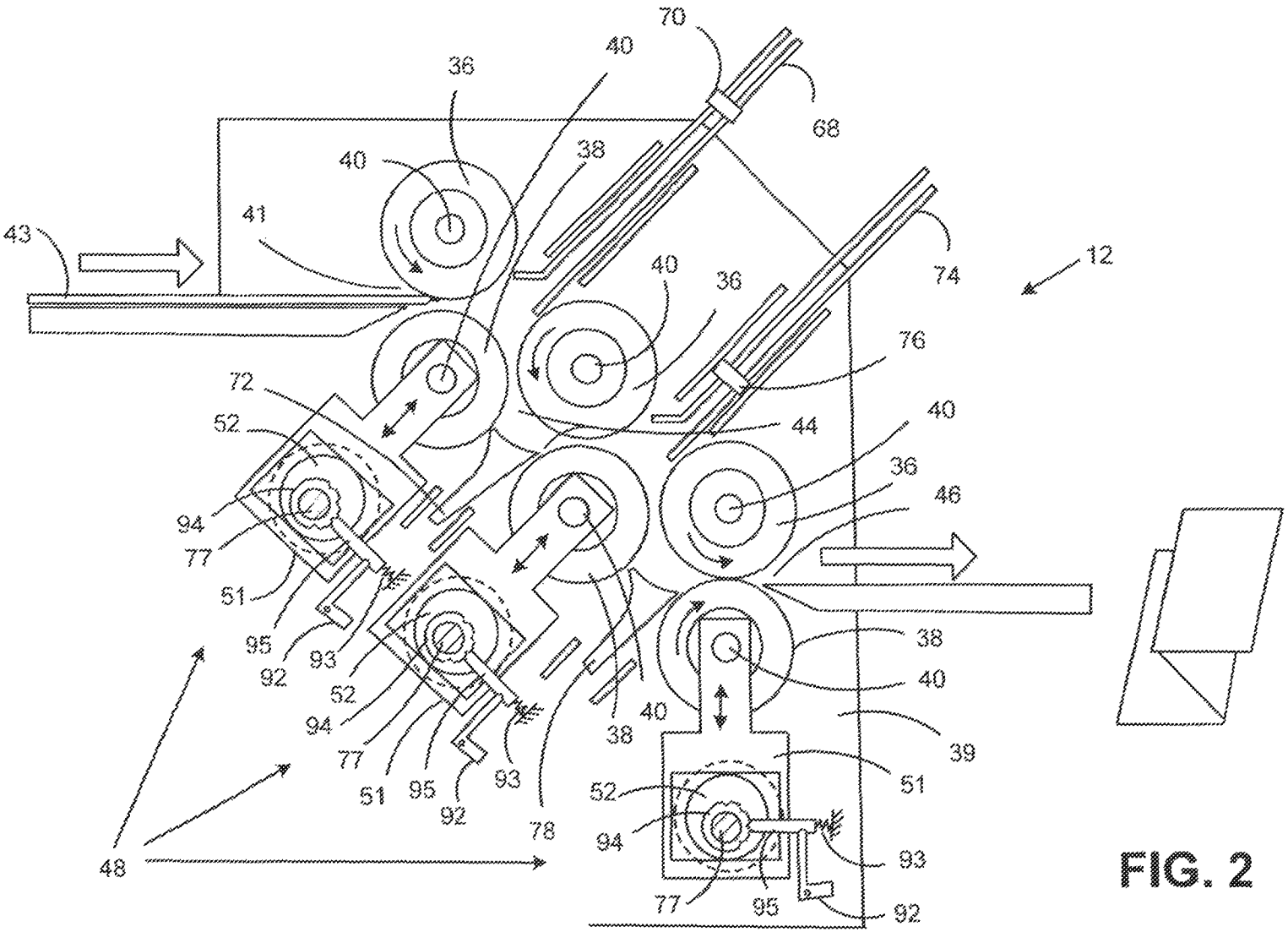
FIG. 2 is a schematic side view of an embodiment of the folder according to the invention.

The folder 12 of the present invention may allow a high quality fold to be consistently achieved for collations having a range of thicknesses without manual adjustment and without degradation of the collation. A schematic side view of an embodiment of the folder 12 according to the invention is shown in FIG. 2. As shown, the folder 12 comprises a plurality of rotatable fold rollers 36 and a plurality of rotatable nip rollers 38 secured in a housing 39. Each nip roller 38 forms a nip having a nip spacing with an adjacent fold roller 36.

Figure 3:
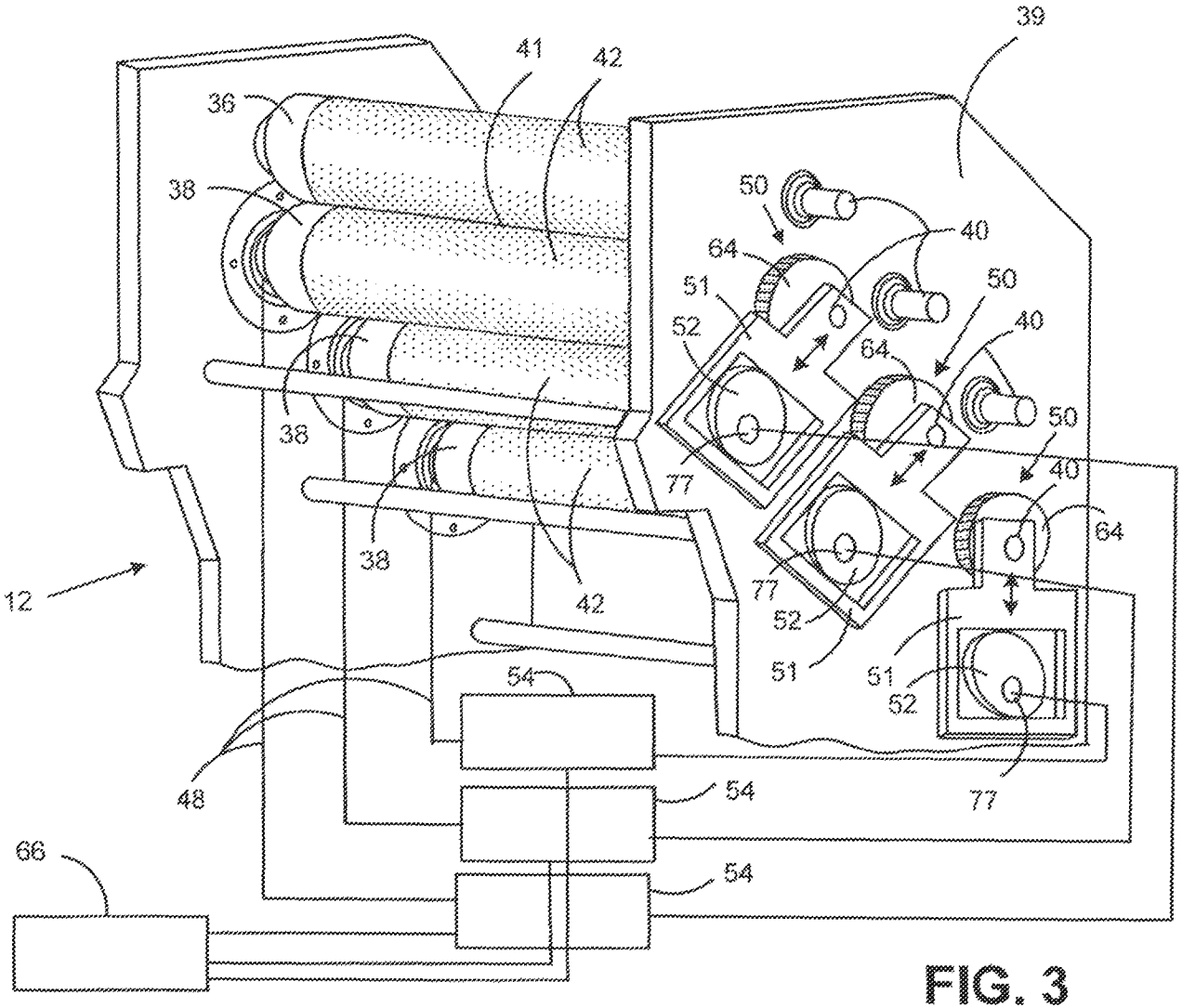
FIG. 3 is a partially schematic view of an embodiment of the folder according to the invention.

The fold rollers 36 and nip rollers 38 include a shaft 40 and a collation contact surface 42 disposed on the shaft, as shown in FIG. 3. The collation contact surface 42 may comprise rubber or other compliant material for gripping the collations 43 and compressing slightly, where required, to accommodate variations in collation thickness. In a preferred embodiment, the surface, 42 is comprised of a grooved elastomeric material to ensure positive drive while transporting and folding collations. The grooves also add system compliance to further accommodate collation thickness variation. The fold rollers 36 and nip rollers 38 are continuously rotated using A/C motors (not shown) in the directions shown by arrows in FIG. 2.

In the illustrated embodiment, the nips comprise an input nip 41 for receiving collations, a plurality of intermediate nips 44 for delivering the collations to one of a buckle chute and a deflector to form folded collations, and an output nip 46 for discharging the folded collations. Folders having different numbers of rollers and, therefore, different numbers of nips may also be used.

The illustrated embodiment further comprises an adjustment system 48 associated with each nip roller 38 for selectively moving the nip roller 38 with respect to the adjacent fold roller 36 based on different collation thickness data to change the nip spacing. The adjustment system 48 moves the shaft 40 of the nip rollers 38 in a linear direction, towards and away from the fold rollers 36, in the direction shown in the arrows in FIG. 2. The movable shaft 40 is mounted on a bearing block cam follower 51, which also moves along the same linear path as the shaft 40. The bearing block cam follower 51 is in turn in operative communication with an eccentric cam 52. Eccentric cam 52 is mounted on an off-center axis shaft 77 that turns the cam. As eccentric cam 52 turns, it pushes or pulls the cam follower 51 along the linear path to increase or decrease the nip spacing.

In the preferred embodiment, the cam follower 51 is built to enclose the eccentric cam 52, as shown in the figures, such that it alternately pushes on an upper side of the cam follower 51 when the nip spacing is being reduced, or pushes on a lower side of the cam follower 51 when the nip spacing is being increased.

In the embodiment shown in FIG. 2, the shaft 77 of the eccentric cam 52 is turned by hand using a knob or a handle. An outer surface 94 on the shaft 77 includes a series of slots or grooves into which a biased pin 95 engages. The pin 95 is biased towards the surface 94 by a spring 93. A lever 92 is used to manually disengage the pin 95, so that the shaft 77 can be rotated to thereby adjust the nip spacing. Each of the slots corresponds to a predetermined nip spacing, so accurate adjustment can be achieved by operating the pin 95 and turning the shaft 77 so that the pin 95 can engage with the slot that corresponds to the desired spacing.

In a preferred embodiment, as seen in FIG. 3, the eccentric cam shaft 77, extends across the width of the folder 12, in parallel with the rollers 38 that are being adjusted. On the opposite side, a corresponding set of eccentric cams 52 and followers 51 are in place to make the adjustment to the far side of roller 38. Thus, in this embodiment, adjustment to the nip spacing on one side of the roller 38 results in the same adjustment being made on the other side.

Figure 7:
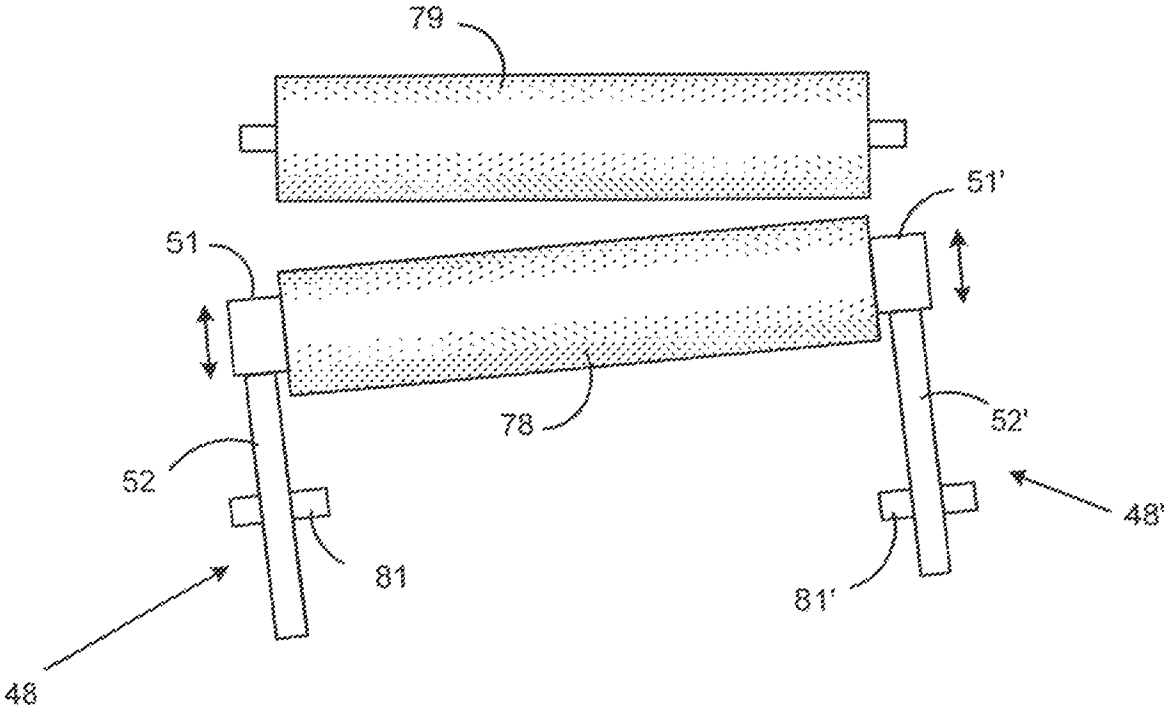
FIG. 7 shows an embodiment of the roller nip in which the gap is independently adjusted on each side.

Alternatively, as shown in FIG. 7, there is no shaft extending across width of the folder 12. In this embodiment, each of the adjustment mechanisms 48 and 48' is independently adjustable, so that nip roller 78 may have a larger gap on one side, than the other. Independent cam 52' is rotated on independent shaft 81, so as to cause follower 51' to move to adjust the nip spacing, just as described above in prior embodiments.

An exaggerated example of variation in the gap adjustment is shown in FIG. 7. Such variation may be desirable if one side of the collation is thicker than the other, from the way the sheets are arranged or from documents that have staples being used to fasten sheets together. Another reason for a greater gap on one side is to offset the difference when a folded collation is being further folded, and the nature of the existing fold causes the collation to be thicker on one side.

Figure 4:
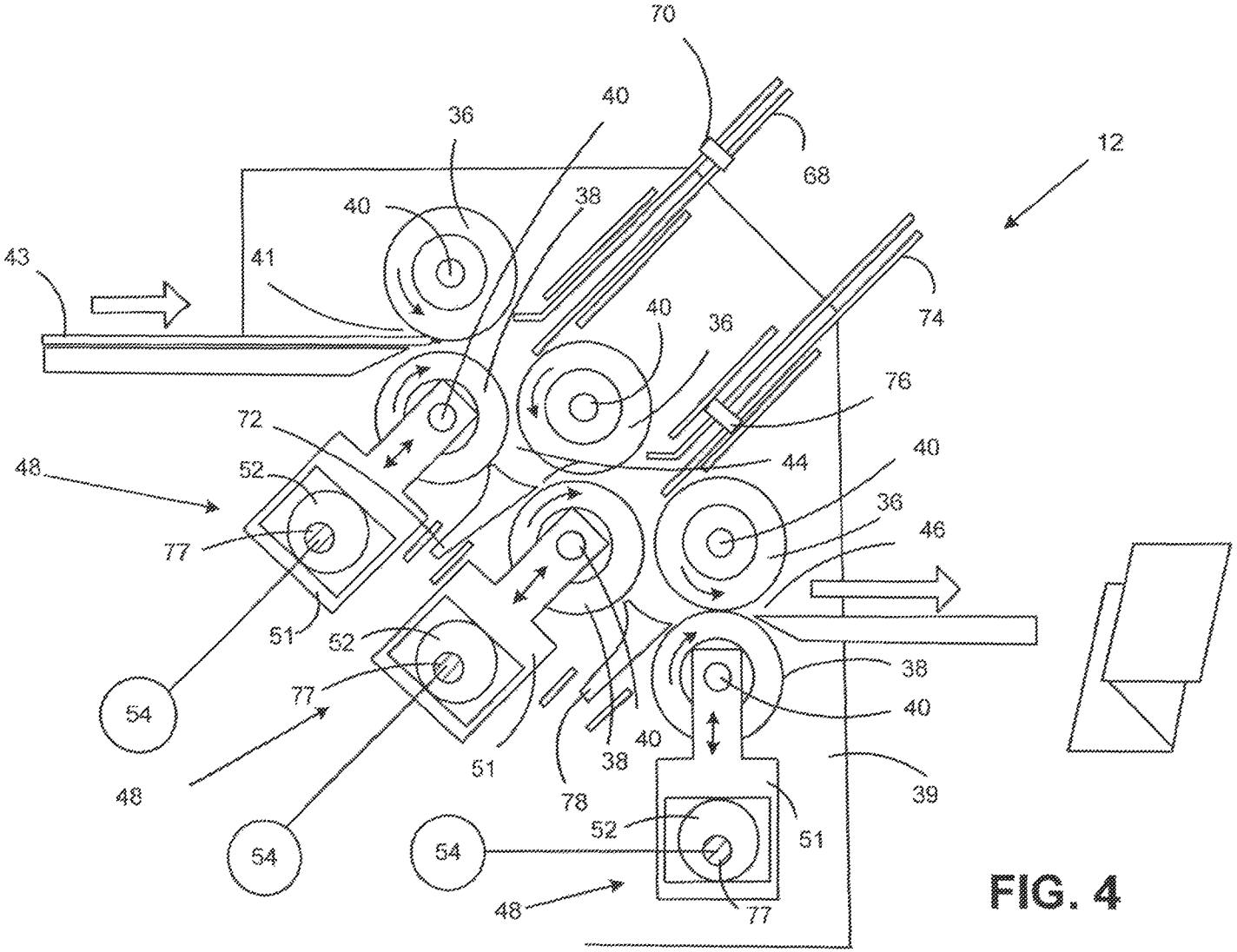
FIG. 4 is shows the side view of the folder including the motorized adjustment embodiment.

As seen in FIGS. 2-4, the desired direction of the movement of the nip roller 38 adjustment is perpendicular to the path of travel of the folded collation 43. Thus adjustment of one of the nip rollers 38 will result in in a change in the gaps with two of the upper fold rollers 36. In the preferred embodiment, the fold rollers 36 are evenly spaced to the path of travel of the nip roller 38, such that the same gap adjustment is achieved relative to each fold roller 36.

In FIGS. 3 and 4, an embodiment is depleted whereby the turning of the eccentric cam 52 is controlled by an electric motor 54. The electric motor 54 turns the shaft in accordance with predetermined settings controlled by controller 66.

In some arrangements, inserter machines create mailpieces based on a data file that contains information regarding the individual mailpieces, or based on information read directly from a code on the documents of the mailpieces. In both arrangements, the inserter is instructed to create collations having a specific number of content pages and, accordingly, a predetermined thickness. The thickness data is provided from the data file or is read from the code on the collation and received by the controller 66. In some embodiments, the data file is stored on a processing device (not shown) associated with the controller 66. Thus, the controller 66 receives the thickness data and generates control signals for the adjustment system 48 associated with each nip roller 38.

During operation, the plurality of fold rollers 36 and the plurality of nip rollers 38 continuously rotate in the directions shown by arrows in FIG. 2 The folder shown in FIG. 2 is configured to fold collations into a "Z-fold" configuration, based on the arrangement of buckle chutes and deflectors. Other arrangements may also be used to fold collations into "C-folds," bi-folds, and other types of folds, for example.

A collation 43 is shown in FIG. 2 being received in the input nip 42. From the input nip 42, the collation 43 enters a first buckle chute 68, which has a depth shorter than the length of the collation 43. As the leading edge of the collation 43 hits a stop 70 in the first buckle chute 68, the continuous rotation of the rollers 36, 38 causes the collation 43 to buckle and fold.

As the collation 43 advances, the fold is drawn into a first intermediate nip 44, which delivers the partially folded collation to a first deflector 72. The collation 43 passes the first deflector 72 with the folded portion as the leading edge and passes through a second intermediate nip 44 to the second buckle chute 74.

Next, the folded portion enters the section buckle chute 74, which also has a depth shorter then the length of the partially folded collation. Again, as the leading edge of the collation hits the stop 76 in the second buckle chute 74, the continuous rotation of the rollers 36, 38 causes the collation to buckle and fold.

As the collation 43 advances, the fold is drawn into a third intermediate nip 44, which delivers the partially folded collation to a second deflector 78. From the second deflector 78, the fully folded collation 43 enters the output nip 46, where it is discharged from the folder 12 in the Z-fold configuration, as shown in FIG. 2.

Sequential collations may comprise bills or financial statements, for example, having different numbers of sheets and, therefore, different thicknesses. In order to process the collations, the controller 66, as shown in FIG. 3, receives the thickness data and generates control signals for the adjustment system 48 associated with each nip roller 38 to accommodate the varied thicknesses of the sequential collations.

In one embodiment, the adjustment system 48 sets the spacing of all nips in the folder 12 to a common nip spacing. In other embodiments, downstream nips are given a larger nip spacing to accommodate the increased thickness of partially folded and fully folded collations. The adjustment system 48 associated with each nip roller 38 may be independently adjusted. Thus, other arrangements may be used in which the spacing of each nip is optimized for a given application.

FIGS. 2-4 depict embodiments wherein the dynamically adjustable roller 36 is positioned below the stationary nip 38. It should be understood that the inventive improvements may also be implemented in the reverse arrangement, wherein the adjustable rollers 36 are positioned above stationary nips 38.

Figure 5:
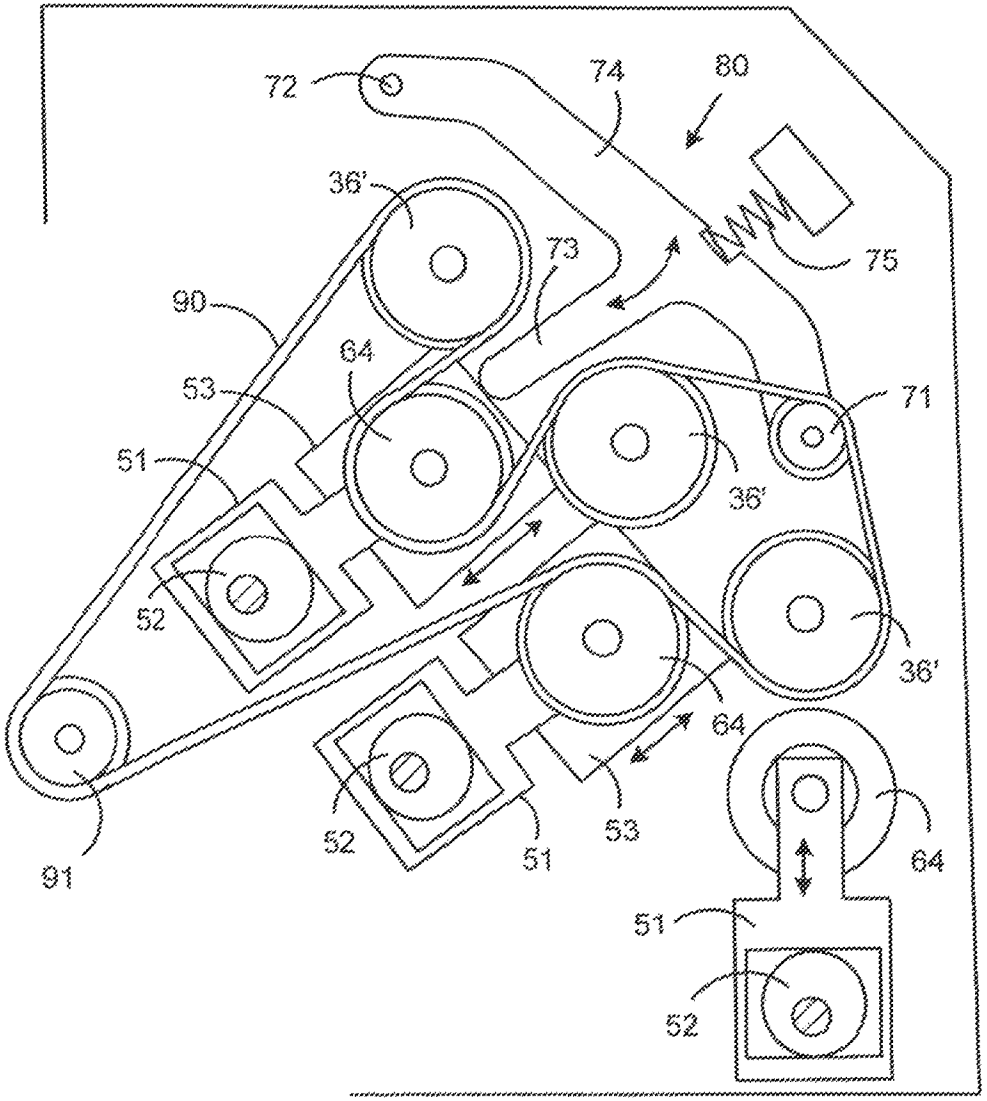
FIG. 5 is a side view showing an embodiment of the automatic tensioner in a first position for adjusting the tension of a drive chain.
Figure 6:
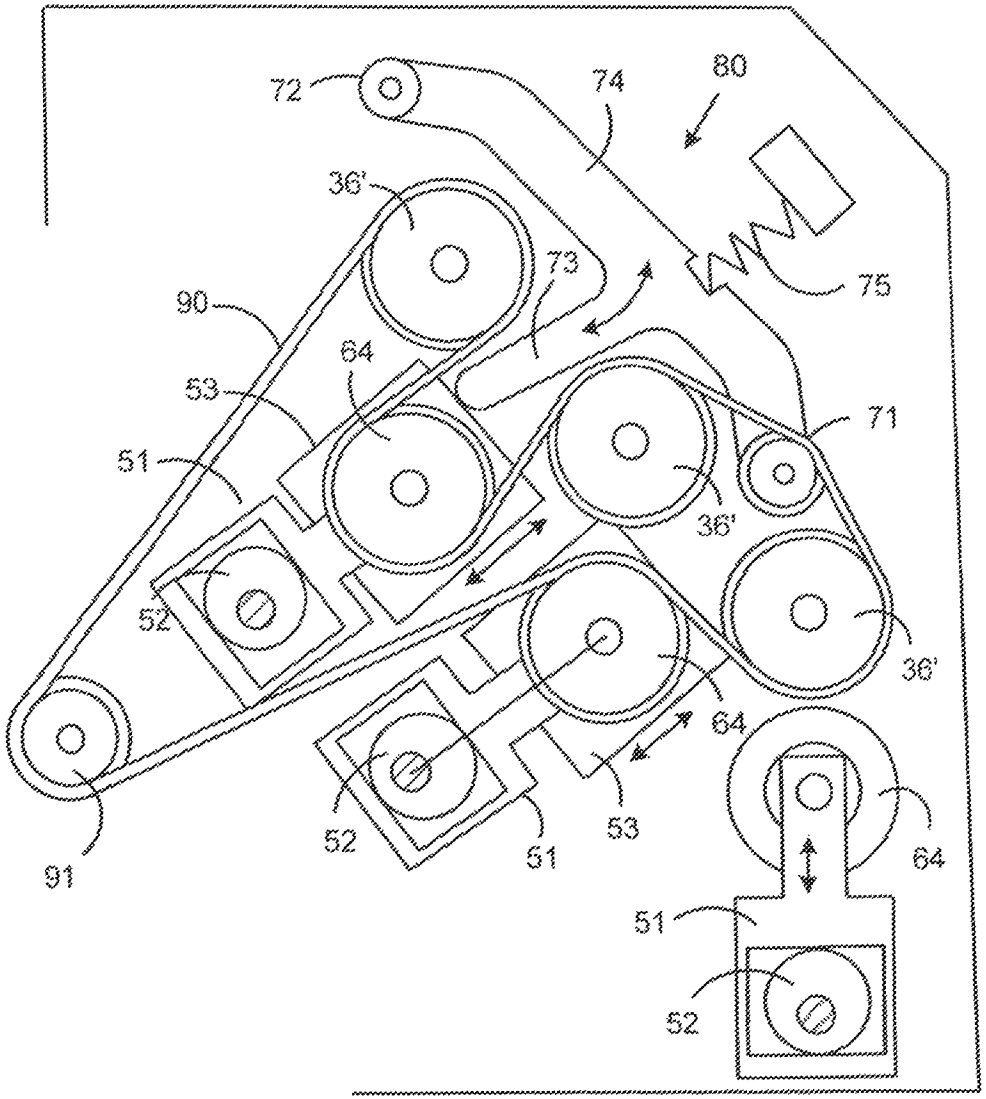
FIG. 6 is a side view showing an embodiment of the automatic tensioner in a second position for adjusting the tension of the drive chain.

FIGS. 5 and 6 depict a further preferred embodiment that utilizes an automatic tensioner 80 to automatically adjust a drive chain 90, to take into account the changing position of components in connection with adjustment of the nip spacing. In this embodiment, a chain 90 is used turn the rollers 36 and 38. The chain 90 engages with gears 64 and 36' mounted on their respective roller shafts 40 for turning those rollers 36, 38. Chain 90 is driven on by a further driven gear 91 that is turned by a motor (not shown).

In this preferred embodiment a chain is used for purposes of turning the rollers, but a belt may also be used. Accordingly, for purposes of this application, it should be understood that a belt is the equivalent of a chain, and the use of the word "chain" also means belt.

Thus it can be seen that nip roller 38, and it turning gear 64, are moved closer and farther from fold rollers 36, and their gears 36', the length of chain 90 needed to span directly between those gears will vary. As the nip spacing is increased, there will be more tension put on chain 90, and as the nip spacing is decreased there will be more slack on chain 90.

Thus, to automatically adjust for these changes in chain 90 tension, the auto-tensioner device 80, as shown in FIGS. 5 and 6, is used. In FIG. 5, the rollers are in adjusted for a narrow nip spacing, and therefore more tension is needed on chain 90 to take up the slack. In FIG. 6, the rollers are in an arrangement with a larger nip spacing, and thus there is a need to relax the tension on chain 90.

Auto-tensioner 80 is preferably made from a link arm 74 that pivots around pivot point 72. A follower arm 73 extends from the link arm 74 to maintain contact with a surface of the bearing block cam follower 53, as the cam follower 53 moves through its different linear positions. Link arm 74 with follower arm 73 are preferably biased towards the cam follower 53 by a spring 75 attached to the structure of the folder 12.

At a distal end of the link arm 74, an idler sprocket 71 is mounted, and is engaged with chain 90. Thus as cam follower 53 moves upward pursuant to narrowing the nip spacing, as shown in FIG. 5, the follower arm 73 pushes the linkage arm 74 to pivot the sprocket 71 to take up the extra slack in the chain 90.

Conversely, as shown in FIG. 6, when the cam follower 53 moves downward while narrowing the nip spacing, the sprocket 71, at the end of link arm 74, will move downward and prevent excess tension on chain 90.

It will be apparent to those skilled in the art that various modifications and variations can be made to the structure and methodology described herein. Thus, it should be understood that the invention is not limited to the examples discussed in the specification. Rather, the present inventor is intended to cover modifications and variations.

What is claimed is:

1. A folder, comprising:

one or more fold rollers mounted in fixed positions;

an adjustable nip roller, the adjustable nip roller positioned adjacent to the one or more fold rollers to form a nip having a nip spacing, the adjustable nip roller being mounted on a nip axis shaft, the nip axis shaft being mounted so as to be linearly movable to adjust the nip spacing;

an adjustment mechanism for moving the nip axis shaft to adjust the nip spacing, the nip adjustment mechanism including:

a bearing block cam follower on which the nip axis shaft is fixedly mounted and supported, the bearing block cam folio being linearly movable to move the nip axis shaft closer and farther from the one or more fold rollers;

an eccentric cam in operative contact with the bearing block cam follower; and whereby rotation of the eccentric cam on the eccentric cam axis will drive the bearing block cam follower in its linear motion to adjust the nip spacing;

wherein the bearing block cam follower is configure to surround the eccentric cam such that a first follower surface is being pushed by the cam when the bearing block cam follower is being pushed towards the one or more fold rollers, and a second follower surface, opposite from the first follower surface, is being pushed by the cam in an opposite direction when the bearing block cam follower is being pushed away from the one or more fold rollers.

2. The folder of claim 1, wherein the adjustment mechanism further comprises:

a manual turning handle and adjustment shaft for turning the eccentric am axis to adjust the nips, and wherein the adjustment shaft includes a series for adjustment slots around an outer circumference of the adjustment shaft; and a biased pin that is positioned to engage with the adjustment slots to prevent turning of the eccentric cam axis while the biased pin is engaged in the adjustment slots, whereby the adjustment slots represent predetermined positions of the eccentric cam that will result in predetermined nip spacing when the adjustment shaft is turned to engage with the biased pin at different slot positions.

3. The folder of claim 1 wherein the eccentric cam axis is driven by a motor, and whereby a motor controller causes adjustment of the nip spacing by controlling rotation of the eccentric cam axis to predetermined positions.

4. A folder, comprising:

one or more fold rollers mounted in fixed positions;

an adjustable nip roller, the adjustable nip roller positioned adjacent to the one or more fold rollers to form a nip having a nip spacing, the adjustable nip roller being mounted on a nip axis shaft, the nip axis shaft being mounted so as to be linearly movable to adjust the nip spacing;

an adjustment mechanism for moving the nip axis shaft to adjust the nip spacing; the nip adjustment mechanism including:

a bearing block cam follower on which the nip axis shaft is fixedly mounted and supported, the bearing block cam follower being linearly movable to move the nip axis shaft closer and farther from the one or more fold rollers;

an eccentric cam in operative contact with the bearing block cam follower; and whereby rotation of the eccentric cam on the eccentric cam axis will drive the bearing block cam follower in its linear motion to adjust the nip spacing;

wherein the adjustment mechanism comprises bearing block eccentric followers and corresponding eccentric cams at both ends of the nip axis shaft, and wherein the corresponding eccentric cams share a common cam shaft that extends parallel to the nip axis shaft, and whereby rotation of the common cam shaft causes both sides of the nip axis shaft to be adjusted by a same spacing.

5. The folder of claim 4 wherein a second independent adjustment mechanism is positioned at an opposite end of the nip axis shaft; the second independent adjustment mechanism comprising a second bearing block eccentric follower and a second corresponding eccentric cam at an opposite end of the nip axis shaft, and whereby the second independent adjustment mechanism can be adjusted to a different nip spacing at the opposite end of the nip axis shaft.

6. A folder, comprising;

one or more fold rollers mounted in fixed positions;

an adjustable nip roller, the adjustable nip roller positioned adjacent to the one or more fold rollers to form a nip having a nip spacing, the adjustable nip roller being mounted on a nip axis shaft, the nip axis shaft being mounted so as to be linearly movable to adjust the nip spacing;

an adjustment mechanism for moving the nip axis shaft to adjust the nip spacing; the nip adjustment mechanism including:

a bearing block cam follower on which the nip axis shaft is fixedly mounted and supported, the bearing block cam follower being linearly movable to move the nip axis shaft closer and farther from the one or more fold rollers;

an eccentric cam in operative contact with the bearing block cam follower; and whereby rotation of the eccentric cam on the eccentric cam axis will drive the bearing block cam follower in its linear motion to adjust the nip spacing; and a single chain that turns the one or more fold rollers and the adjustable nip roller, and whereby adjustment of the adjustable nip roller changes a length of the single chain needed to turn the rollers, the adjustment mechanism further comprising an automatic tensioner that automatically adjusts tension on the single chain to account for movement of the adjustable nip roller.

7. The folder of claim 6 wherein the automatic tensioner comprises:

a pivoting link arm that is in operative communication with the bearing block cam follower such that the pivoting link arm moves back and forth following the movement of the bearing block cam follower;

an idler sprocket mounted on the pivoting arm and engaged with the single chain, whereby the movement of the pivoting link arm causes the idler sprocket to take up extra tension when the nip spacing is being decreased and to release tension when the nip spacing is being increased.

8. The folder of claim 7 wherein the pivoting link arm is spring biased towards the bearing block cam follower, and the pivoting link arm includes a follower arm that extends from the link arm to engage with a surface of the bearing block cam follower.

9. A method of adjusting nip spacing in a collation folding device the collation folding device comprising: one or more fold rollers mounted in fixed positions: an adjustable nip roller, the nip roller positioned adjacent to the one or more fold rollers to form a nip having a nip spacing, and the adjustable nip roller being mounted on a nip axis shaft, the nip axis shaft being mounted so as to be linearly movable to adjust the nip spacing; the method comprising:

using an adjustment mechanism to move the nip axis shaft to adjust the nip spacing; wherein the adjustment mechanism includes a bearing block cam follower on which the nip axis shaft is fixedly mounted and supported, the bearing block cam follower being linearly movable to move the nip axis shaft closer and farther from the one or more fold rollers and an eccentric cam in operative contact with the bearing block cam follower; and whereby rotation of the eccentric cam on the eccentric cam axis drives the bearing block cam follower in its linear motion to adjust the nip spacing, wherein the adjustment mechanism comprises bearing block eccentric followers and corresponding eccentric cams at both ends of the nip axis shaft, and wherein the corresponding eccentric cams share a common cam shaft that extends parallel to the nip axis shaft, and including the step of simultaneously causing both sides of the nip axis shaft to be adjusted by a same spacing by rotating the common cam shaft.

10. The method of claim 9, wherein the adjustment mechanism further comprises a manual turning handle and adjustment shaft for turning the eccentric cam axis to adjust the nips, and wherein the adjustment shaft includes a series for adjustment slots around an outer circumference of the adjustment shaft; and a biased pin that is positioned to engage with the adjustment slots to prevent turning of the eccentric cam axis while the biased pin is engaged in the adjustment slots, whereby the adjustment slots represent predetermined positions of the eccentric cam that will result in predetermined nip spacing when the adjustment shaft is turned to engage with the biased pin at different slot positions and including the steps of;

disengaging the biased pin from a first adjustment slot;

turning the adjustment shaft to a second position that corresponds to a desired nip spacing; and engaging the biased pin into a second adjustment slot to prevent further turning of the adjustment shaft.

11. The method of claim 9 including a further step of driving the eccentric cam axis with a motor, and controlling the motor controller to adjust the nip spacing by controlling rotation of the eccentric cam axis to predetermined positions.

12. The method of claim 9 wherein a second independent adjustment mechanism is positioned at an opposite end of the nip axis shaft; the second independent adjustment mechanism comprising a second bearing block eccentric follower and a second corresponding eccentric cam at an opposite end of the nip axis shaft, and including a step of independently adjusting the second independent adjustment mechanism to cause a different nip spacing at the opposite end of the nip axis shaft.

13. A method of adjusting nip spacing in a collation folding device the collation folding device comprising: one or more fold rollers mounted in fixed positions; an adjustable nip roller, the nip roller positioned adjacent to the one or more fold rollers to form a nip having a nip spacing, and the adjustable nip roller being mounted on a nip axis shaft, the nip axis shaft being mounted so as to be linearly movable to adjust the nip spacing; the method comprising:

using an adjustment mechanism to move the nip axis shaft to adjust the nip spacing; wherein the adjustment mechanism includes a bearing block cam follower on which the nip axis shaft is fixedly mounted and supported, the bearing block cam follower being linearly movable to move the nip axis shaft closer and farther from the one or more fold rollers and an eccentric cam in operative contact with the bearing block cam follower; and whereby rotation of the eccentric cam on the eccentric cam axis drives the bearing block cam follower in its linear motion to adjust the nip spacing;

wherein a single chain turns the one or more fold rollers and the adjustable nip roller, and whereby adjustment of the adjustable nip roller changes a length of the single chain needed to turn the rollers, and including a step of using an automatic tensioner to automatically adjust tension on the single chain to account for movement of the adjustable nip roller.

14. The method of claim 13 wherein the step of using the automatic tensioner includes providing a pivoting link arm that is in operative communication with the bearing block cam follower such that the pivoting link arm moves back and forth following the movement of the bearing block cam follower; an idler sprocket mounted on the pivoting arm and engaged with the single chain, whereby the movement of the pivoting link arm causes the idler sprocket to take up extra tension when the nip spacing is being decreased and to release tension when the nip spacing is being increased.

15. The method of claim 14 including steps of spring biasing the pivoting link arm towards the bearing block cam follower, and providing a follower arm on the link arm that extends from the link arm to engage with a surface of the bearing block cam follower.

* * * * *